US005178310A

United States Patent [19]

Sowerby

[11] Patent Number: 5,178,310

[45] Date of Patent: Jan. 12, 1993

[54] STRADDLE PACK ORGANIZER AND METHODS

[76] Inventor: Priscilla K. Sowerby, 49 Woodhaven Cir., Ormond Beach, Fla. 32176

[21] Appl. No.: 691,795

[22] Filed: Apr. 26, 1991

[51] Int. Cl.[5] ..... A45F 4/02; A45F 5/00; A45F 3/04

[52] U.S. Cl. ..... 224/153; 224/206; 224/209; 224/236

[58] Field of Search ..... 224/153, 155, 206, 209, 224/235, 236, 32 A, 42.11; 190/1, 8, 9, 10, 12 A, 103; 297/118, 129, 187, 188, 229; 5/420, 462, 466

[56] References Cited

U.S. PATENT DOCUMENTS

| | | | |
|---|---|---|---|
| 2,096,768 | 10/1937 | Styll | 190/103 X |
| 2,105,319 | 1/1938 | Hedden et al. | 224/155 X |
| 2,865,433 | 12/1958 | Warner | 190/8 X |
| 2,909,215 | 10/1959 | Mitchell | 297/188 |
| 4,050,491 | 9/1977 | Hargrove | 297/188 |
| 4,518,198 | 5/1985 | Daniels | 297/118 |
| 4,553,785 | 11/1985 | Duke | 297/188 X |
| 4,854,637 | 8/1989 | McCree | 297/188 |
| 4,856,570 | 8/1989 | Rushing et al. | 224/153 X |
| 4,863,003 | 9/1989 | Carter | 190/1 X |
| 4,892,353 | 1/1990 | Goddard | 297/188 X |
| 4,901,897 | 2/1990 | Briggs et al. | 224/209 X |
| 4,917,505 | 4/1990 | Bullard et al. | 190/1 X |

FOREIGN PATENT DOCUMENTS

| | | | |
|---|---|---|---|
| 2478972 | 10/1981 | France | 190/1 |
| 14947 | of 1913 | United Kingdom | 297/183 |
| 29532 | of 1913 | United Kingdom | 297/183 |

*Primary Examiner*—Henry J. Recla
*Assistant Examiner*—Glen T. Barrett

[57] ABSTRACT

A central straddle-sheet section (1) made of fiber or other foldable material is provided with a pocket section (2 and 3) at each end. Each pocket section (2 and 3) is sufficiently narrow not to overlap the other when both are folded onto the central straddle-sheet section (1) at fold lines (10 and 11) where the pocket sections (2 and 3) are joined to the central straddle-sheet section (1). When the straddle pack organizer is straddled over a chair (18) or other surface, the pockets (6 and 8) in the pocket sections (2and 3) hang or lay to each side of the chair to form easily-reachable pockets for holding folders, notebooks and other materials. A carrying case is formed when the pockets are folded over the central straddle-sheet section (1) and the central straddle-sheet section (1) then is folded at a central fold line (12) between the folded pocket sections (2 and 3). In a folded-case mode, the pockets (6 and 8) are vertical with a portion of the central straddle-sheet section (1) covering the opening (7 and 9) of each pocket (6 and 8) are with openings (7 and 9) upright above the pockets (6 and 8). The straddle pack organizer may be carried on the back by back-pack straps (4) are attached from end-to-end at each side of the central straddle-sheet section (1), or by hand using hand-grasp straps (13) attached from side-to-side at each end of the central straddle-sheet section (1).

5 Claims, 4 Drawing Sheets

FIG. 1
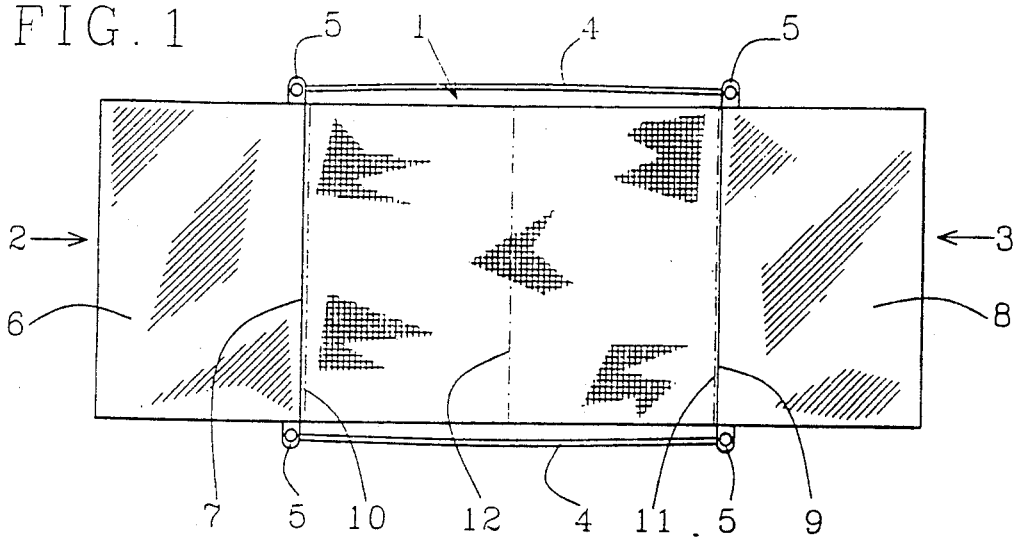
FIG. 2
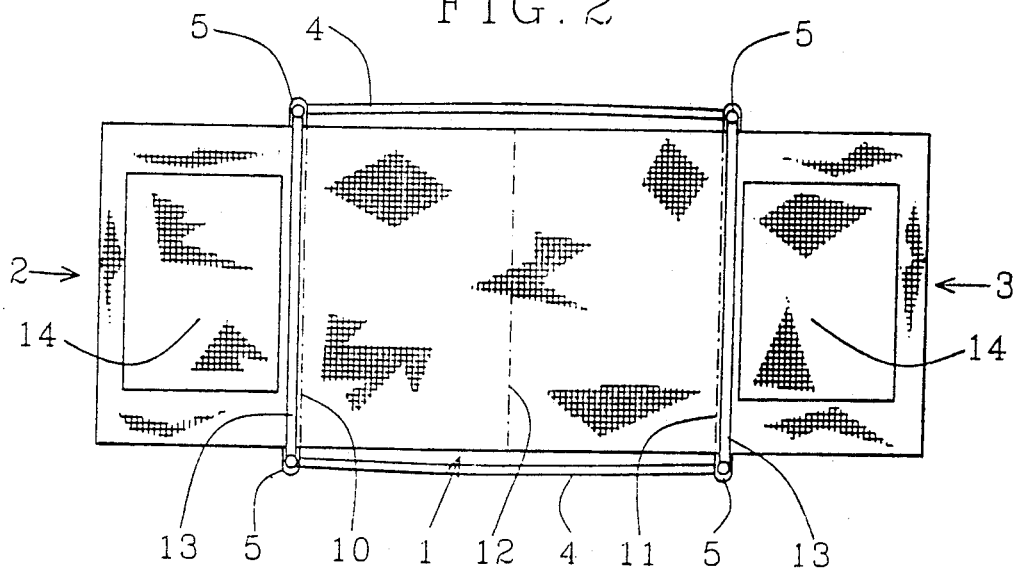
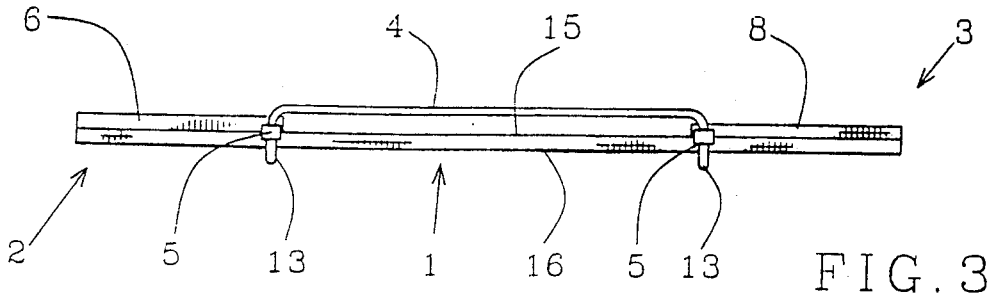
FIG. 3

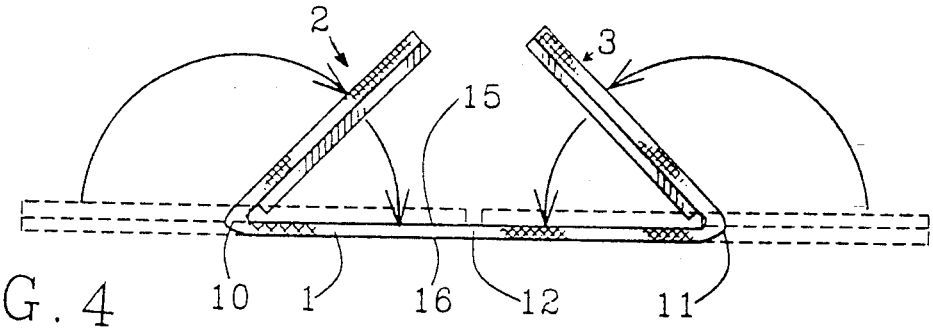
FIG. 4
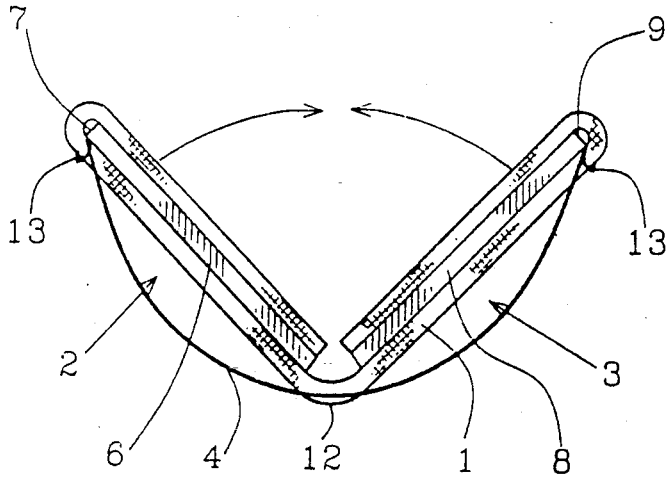
FIG. 5
FIG. 6
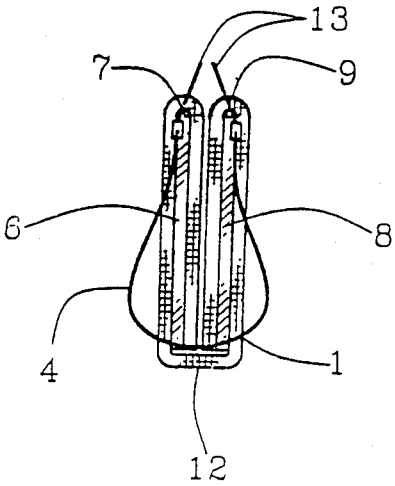
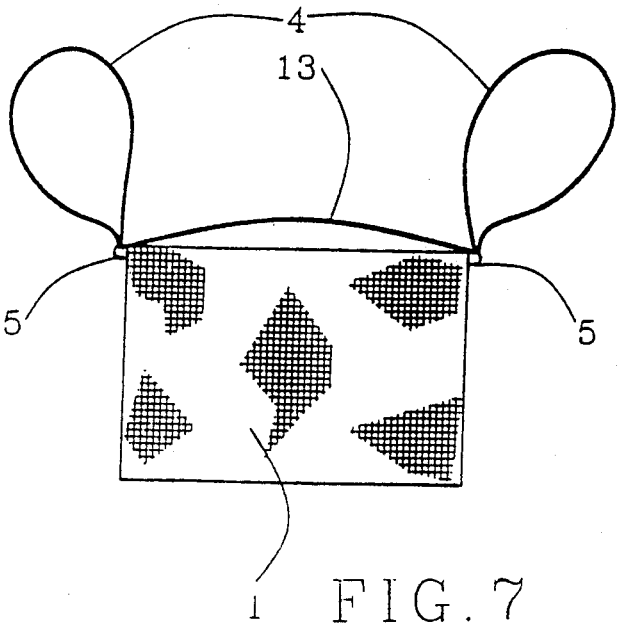
FIG. 7

FIG. 8
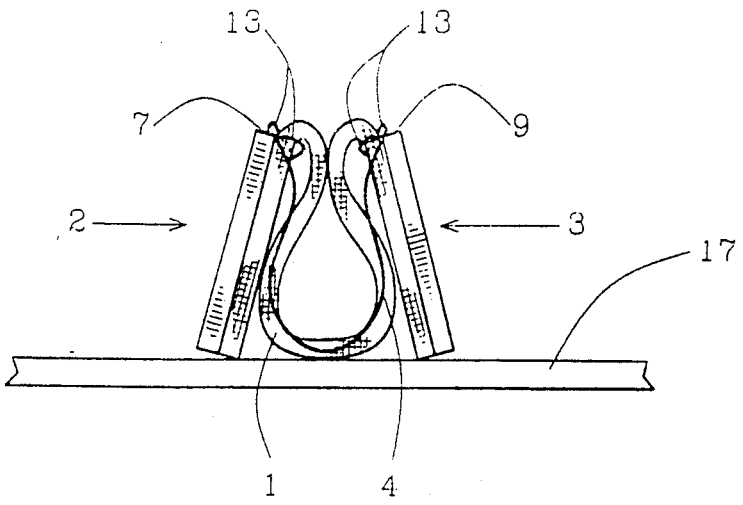
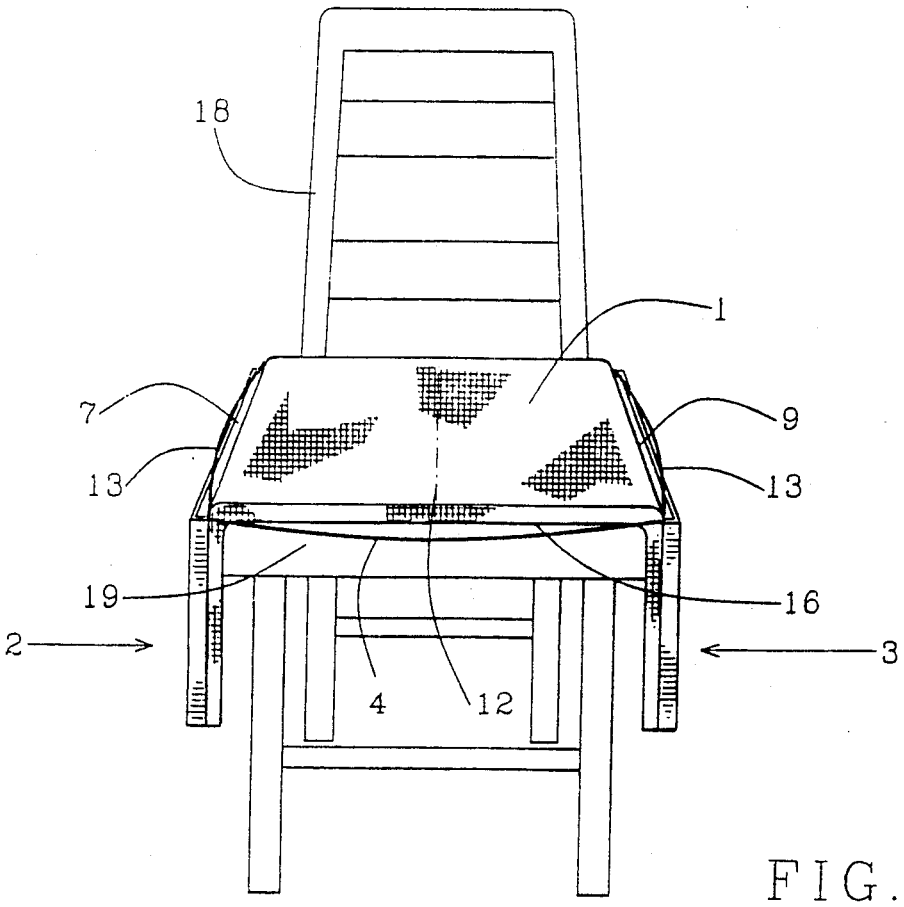
FIG. 9

STRADDLE PACK ORGANIZER AND METHODS

BACKGROUND OF THE INVENTION

This invention relates to hand-carrying and back-pack bags. More specifically, it relates to a foldable bag which can be positioned over a chair or other platform as a work surface cover with organizer pockets hanging from the sides when in an unfolded condition. In folded condition it is a form of case that can be either hand carried or back-pack carried.

Students in schools and colleges are required to carry books, paper, writing tablets and other educational paraphernalia with them from class-to-class. Often, the distances are so long that bicycles are used to commute to and from schools as well as between classrooms. At times also, students go to parks and other outdoor places to study and think about what they are learning. When they get to their classes, study halls, libraries, dwellings or other destinations, it is helpful for their educational items to be organized and conveniently accessible right next to where they are sitting or writing. Having a pad or cushion to sit on adds comfort and conduciveness of learning environments. Stadium attendees, back-packers, artists, travelers and others also often find themselves in need of a container with features similar to those which benefit students. There has been no container previously that provides benefits for all of these conditions as well as this invention.

Prior art which is related but different includes the following U.S. patent documents:

| U.S. Pat. No. | Inventor | Date |
|---|---|---|
| 4,892,353 | Goddard | Jan. 9, 1990 |
| 4,863,003 | Carter | Sep. 5, 1989 |
| 4,854,637 | McCree | Aug. 8, 1989 |
| 4,687,248 | Ross et al. | Aug. 18, 1987 |
| 4,553,785 | Duke, Jr. et al. | Nov. 19, 1985 |
| 4,050,491 | Hargrove | Sep. 27, 1977 |
| 2,909,215 | Mitchell | Oct. 20, 1959 |
| 1,934,615 | Selverstone | Nov. 7, 1933 |

The Goddard patent described a cover for a chaise lounge chair. It featured drop pockets at sides of the cover similar to this invention. But the entire cover was different in that it was not foldable into a hand or back-pack carrying case as taught by this invention.

The Carter patent appears to resemble this invention more closely that any other prior art believed to exist, but is also quite different. Unlike this invention, however, the Carter device is a combination seat cushion and tote bag with side pockets which fold over each other at one side of a seat cushion. The side pockets in the Carter device are attachable to each other to prevent them from unfolding when being carried. Fundamentally different, side pockets in this invention are not folded over each other nor fastened to each other to prevent their unfolding. Instead, side pockets or drop pockets are folded first onto a central straddle-sheet section without overlapping or folding over each other. Then the central straddle-sheet section is center-folded to form a cover at each side of pocket section sin addition to covering openings to the pockets. Pockets in the Carter system are left on their sides such that a zipper or other fastening means is necessary to prevent items from falling out when in carrying mode as described. This invention in carrying mode positions pockets upright and, in addition, provides a covering to prevent escape of items from the pockets. The Carter patent specifically described its pockets as being wide enough to overlap and to be attached to each other at a common overlap section. This overlap feature would prevent folding of the cushion section without also folding or bending the pockets and any books, tablets or other items which this invention is devised to carry. A handle section which renders this invention back-packable as well as hand-carryable also would not be possible and was not foreseeable within the teachings of the Carter patent. In the Carter device, a handle was attached to a single free side rather than from side-to-side at both ends or from end-to-end of both sides of the critically-different form of this invention. In addition to these fundamental differences that are essential to its structural nature and working relationship of parts, there are other advantageous features made possible with this invention.

McCree taught a cushion with pocket foldable over it on one side and back-pack straps on the other.

Ross et al. described a convertible lounge chair-tote bag with foldable legs

Duke, Jr. et al. provided a removable and washable cover for a beach lounge chair with pocketed skirts at its edges.

The Hargrove patent covered a combined school chair and a side pocket for it.

Mitchell taught a folding chair equipped for fishing with a drop pocket in front and fishing-rod holders on arms of the chair.

Selverstone described a particular type of cushion for a chair.

None of the above patents teaches any device similar to the present invention.

SUMMARY OF THE INVENTION

One object of this invention is to provide a case for carrying textbooks, notebooks, paper, writing instruments, art supplies, food, light clothing and other items related to school, business and recreation.

Another object is to provided a pad on which to sit with the items in the case positioned for convenient accessibility next to the pad when it is straddled over a chair.

Another object is to provide a pad on which to write or to position books for being read with the items in the case positioned for convenient accessibility at the sides of a platform such as a school desk over which the pad is straddled.

Another object is to provide a pad which can be laid out over the ground, over a lawn or over such natural formations as rocks, tree limbs or logs, with the items in the case positioned for convenient accessibility at the sides of the pad.

Another object is to provide an organizer file divider of items carried in the case.

Another object is to provide a combined pad and organizer which can be folded and hand-carried like a brief case or purse with a cover over items in the case to prevent them from falling out.

Another object is to provide a carrying case that can be folded backwards and stood up on a surface in free-standing condition with tops of pockets open for convenient accessibility.

Another object is to provide a combined pad and organizer in which items are in pockets that are upright with openings to the pockets vertically above the pockets to be able to utilize gravity to hold items in the case when it is folded in carrying mode.

Another object is to provide a combined pad and organizer case which can be back-pack or chest carried while walking, riding a bicycle, hiking or otherwise traveling or standing.

Another object is to provide a sanitary cover of chairs, particularly for individuals wearing shorts or skirts.

Another object is to provide a space-saver for storing the contents of the case together with the case in relatively small living and traveling quarters.

Yet another object of this invention is to provide a locking means for locking shut a foldable organizer case having a pad and organizer pockets.

The present invention accomplishes these and other apparent objectives by providing a straddle pack organizer having a central straddle-sheet section made of fiber or other foldable material with a pocket section at each end. Each pocket section is sufficiently narrow not to overlap the other when both are folded onto the central straddle-sheet section at fold lines where the pocket sections are joined to the central straddle-sheet section. When the straddle pack organizer is straddled over a chair, desk or other surface, the pockets in the pocket section hang or lay to the sides. A carrying case is formed when the pockets are folded over the central straddle-sheet section and the central straddle-sheet section is folded at a central fold line between the folded pockets. In a folded-case mode, the pockets are vertical with a portion of the central straddle-sheet section covering the opening of each pocket and with the openings upright above the pockets. Back-pack straps are attached from end-to-end at each side of the central straddle-sheet section. Hand-grasp straps are attached from side-to-side at each end of the central straddle-sheet section.

BRIEF DESCRIPTION OF THE DRAWINGS

This invention is described by appended claims in relation to a description of a preferred embodiment and the following drawings wherein:

FIG. 1 is a top view of the invention in a flat open mode;

FIG. 2 is a bottom view in flat open mode;

FIG. 3 is a side view in flat open mode;

FIG. 4 is a side view with pocket sections being folded over a central straddle-sheet section;

FIG. 5 is a side view with the central straddle-sheet section being folded along a center line after the pocket sections are folded over the central straddle-sheet section;

FIG. 6 is a side view of the straddle pack organizer in folded case mode;

FIG. 7 is an end view of the straddle pack organizer in folded case mode with hand and shoulder straps in carrying position;

FIG. 8 is a side view of the straddle pack organizer standing upright in reverse-folded, free-standing mode with tops of pocket sections leaning against each other to support vertical positioning and with pockets open for convenient accessibility;

FIG. 9 is a top perspective view of the straddle pack organizer straddled over a chair with the central straddle-sheet section resting on the chair and the pocket sections in drop-pocket position at sides of the chair;

DESCRIPTION OF THE PREFERRED EMBODIMENTS

Figure 10:
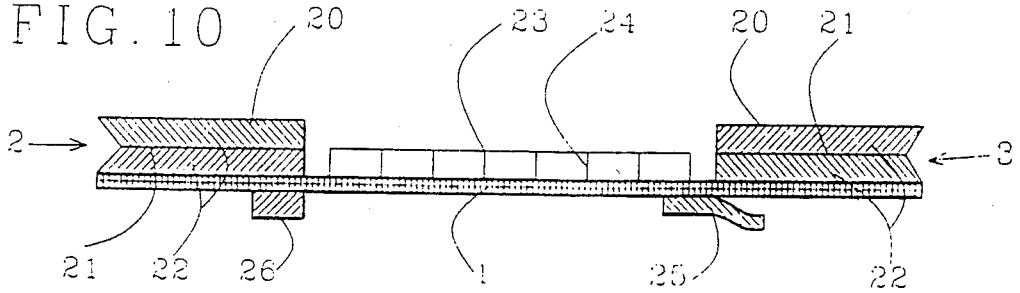
FIG. 10 is a side view of an embodiment of the straddle pack organizer in flat open mode with a cushion on top of the central straddle-sheet section and with a lock sheet and lock receiver attached to an outside surface of the straddle pack organizer.

A description of the preferred embodiments of this invention in various modes and forms is referenced to the drawing figures. Referring first to FIG. 1, this straddle pack organizer is provided with a central straddle-sheet section 1 having a left pocket section 2 and a right pocket section 3 extended from its opposite ends. In this top view, two back-pack straps 4 are visible. The back-pack straps 4 can be attached to the straddle pack organizer with attachment loops 5 sewn or otherwise attached directly to opposite sides of the straddle pack organizer proximate where the pocket sections 2 and 3 are extended from the central straddle-sheet section 1. A left pocket 6 is provided with a left pocket opening 7 and a right pocket 8 is provided with right pocket opening 9. In a basic form of this invention, pockets 6 and 8 are on the top side of the straddle pack organizer.

With the straddle pack organizer is folded from a flat-open mode, illustrated in FIGS. 1, 2, 3, 10, 13, and 14 to a folded-case mode illustrated in FIGS. 6, 7, 11 and 12, left fold line 10, right fold line 11 and central fold line 12 are formed. Left fold line 10 can be at or close to left pocket opening 7. Likewise, right fold line 11 can be close to right pocket opening 9. Exact positioning of the left and right fold lines will depend on the thickness and physical nature of material used for construction. It will depend also on thickness and form of pockets in the pocket sections 2 and 3.

The same fold lines 10, 11 and 12 are formed in approximately the same positions when straddle pack organizer is folded backwards to a free-standing and open pocket mode illustrated in FIG. 8.

The central straddle-sheet section 1 can be constructed of a wide variety of fibrous, leather, plastic or other material which is foldable at fold lines 10, 11, and 12. It can be constructed of material which is variably foldable or even flimsy throughout, depending on design objectives for particular use conditions. In this FIG. 1 illustration, a fibrous material is indicated with non-fibrous coverings over pockets 6 and 8. When made of relatively thick or stiff material, this straddle pack organizer can be made to resemble a brief case in its folded mode. When made of a thin or flimsy material, it can be just a big and hold just as much yet be foldable when not in use to fit inside of a person's clothing pocket or purse. The stiff-material construction would be more appropriate for use-conditions requiring free-standing, access ease and covering characteristics.

Flimsy construction could be more appropriate for ease of portability and storage when not in use.

Material from which the central section is constructed can be extended throughout the length of the straddle pack organizer. It then forms a wall of the pocket sections 2 and 3. Some of the various characteristics of different functions of the parts of this straddle pack organizer will become apparent from further description of its forms and embodiments.

Referring now to FIG. 2, handle straps 13 are visible from a bottom side of this straddle pack organizer. The handle straps 13 can be attached to the same attachment loops 5 that are used for attaching the back-pack straps 4. Alternatively, the same as for the back-pack straps 4, the handle straps 13 can be attached directly to sides of the straddle pack organizer in the vicinity of left and right fold lines 10 and 11. The handle straps 13 are extended from side-to-side across the bottom side of the straddle pack organizer while the back-pack straps 4 are extended from end-to-end of the central straddle-sheet section 1 without particular relationship to top or bottom of the straddle pack organizer. Optionally, the handle straps 13 can be extended from side-to-side across both the bottom and top of the straddle pack organizer.

The handle straps 13 can be extensions of the same material as the back-pack straps 4. However, it may be preferable for the back-pack straps 4 to be relatively wide to accommodate carrying particularly heavy or large straddle pack organizers over a person's shoulders on either their back or their chest. When a single strand of material is used for both straps 4 and 13, it is preferable that the strand be anchored at the positions of the loops 5, particularly when flimsy material is used for construction of the straddle pack organizer. A single or similar strand of strap material can be a small rope, a strong string or the equivalent of a ribbon or shoe string.

An optional bottom pocket 14 can be provided at the bottom side of either or both pocket sections 2 and 3. The bottom pocket 14 can be the same size or smaller than the pocket section as illustrated in FIG. 2. Like pockets 6 and 8, pockets 14 can be the same or different material from the rest of the straddle pack organizer. They are illustrated in FIG. 2 as similar material.

Reference is now made to FIG. 3. Pockets 6 and 8 are on top side 15 of a central straddle-sheet section 1 which is extended the full length of the straddle pack organizer to opposite sides of the pocket sections 2 and 3. Back-pack straps 4 are extended between loops 5 from pocket opening 7 to pocket opening 9. Handle straps 13 are extended downwards to be positioned across a bottom side 16 of the straddle pack organizer.

The thickness of material in the drawings is indicated as being relatively wider than would be used for most construction for ease of illustration of the parts and their constructional relationships. For some materials, there would only be a thin line for all parts if actual size relationships were maintained for this illustration. The same principal of size relationships is used throughout the drawings in accordance with standard practices for patent descriptions.

Referring to FIG. 4, pocket sections 2 and 3 are folded over the top side 15 of central straddle-sheet section 1 as a first step in achieving a folded-case mode illustrated in FIGS. 5, 6, 11 and 12. Dashed lines indicate where the bottom sections started from in flat, open mode and where they are positioned at the end of a first fold step in the direction of curved arrows.

In FIG. 5, the pocket sections 2 and 3 are shown being folded along with sides of the central straddle-sheet section along fold line 12. The back-pack strap 4 is being formed into a loop as folding at the central fold line 12 proceeds. Hand straps 13 are at the bottom side 16 where they will form handles in the folded-case mode.

FIG. 6 illustrates the folded-case mode by end view. The handle straps 13 can be lifted up as shown for a combined handle that holds the straddle pack organizer in folded mode. Pockets 6 and 8 are upright vertically with pocket openings 7 and 9 above the pockets 6 and 8 to retain items in the pockets 6 and 8 when in vertical orientation. The pockets 6 and 8 are covered with portions of material comprising the central straddle-sheet section 1 to restrain items from falling out of the pockets 6 and 8 when the straddle pack organizer may be in a relatively horizontal or upside-down condition.

In FIG. 7, the back-pack straps 4 are lifted and opened in looped form to allow insertion of an individual's arms through them for carrying the straddle pack organizer on the individual's back or chest. Hand straps 13 are shown raised also for optional carrying like a brief case or hand bag.

Referring to FIG. 8, pocket sections 2 and 3 are leaning against each other with the central straddle-sheet section 1 dangling between fold lines 10 and 11. This forms a free-standing or upright mode for ease of access to the pockets 6 and 8 when the straddle pack organizer is placed on a flat surface 17 such as a table, floor or other supportive surface. Also hanging or dangling between fold lines 10 and 11 and between pocket openings 7 and 9 are back-pack straps 4 in this free-standing mode. However, handle straps 13 can be provided at both the top side 15 and the bottom side 16 of the central straddle-sheet section 1 in order to provide handles for carrying the straddle pack organizer in this free-standing mode. However, handle straps 13 can be provided at both the top sides 15 and bottom side 16 of the central straddle-sheet section 1 in order to provide handles for carrying the straddle pack organizer in this free-standing mode. High utility of the free-standing mode renders it highly preferable to provide handles for this form with handle straps 13 at both the top 15 and bottom 16 of the central straddle-sheet section 1.

Referring now to FIG. 9, the straddle pack organizer is illustrated straddled over a chair 18 with the bottom side 16 of the central straddle-sheet section 1 resting on the surface of the seat 19 of the chair 18. The pocket sections 2 and 3 are in drop-pocket relationship to the central straddle-sheet section 1 at sides of the chair where items in pockets 6 and 8 can be accessed conveniently by an individual sitting in chair 18. In this mode, the straddle pack organizer provides the dual function of an organizer file and a seating pad. This will be the most utilitarian mode for most individuals.

Chair seat 19, however, is representative of a wide variety of platforms over which this straddle pack organizer can be straddled for use as an organizer. It could be a school desk, a park bench, a stadium bench, a chair back, a tree limb, a log, the back of a car seat, a bicycle frame, a large rock or any other appropriately sized protrusion wherever a user may be. In any event, items in the pockets 6 and 8 are easily accessible and the central straddle-sheet section 1 can provide a pad for sitting, writing, propping a book, sketching or any desired use. It will prove useful for applications ranging from bird-watching and back-packing to classrooms and science labs.

Referring to FIG. 10, sections 2 and 3 are shown with optional multiple-section pockets 20 having dividers 21 at optional accordion-type walls 22. This provides expandable pockets for containing books, food, electronic equipment and other items with relatively bulky proportions. An optional cushion 23 can be provided at preferably the top side 15 of the central straddle-sheet section 1. The cushion can be a sectioned inflatable pad illustrated schematically with cushion section lines 24. A suitable cushion that is also pliably foldable can add significant creature comfort. Additionally optional, a lock sheet 25 can be positioned at the bottom side 16 in the vicinity of a fold line 10 or 11. At the opposite fold line or appropriately towards an opposite end of the straddle pack organizer, a lock receiving member 26 can be positioned to receive or otherwise retain lock sheet 25 in folded-case mode. A lock sheet can be in the form of a brief-case or hand-bag cover with fastening material thereon. It is referred to as a sheet in order to conform to whatever material is used for construction of the straddle pack organizer. Functions of this lock sheet and lock receiver combination are to deter pilfering, to prevent the folded-case mode from unfolding in the likelihood of being dropped or tossed around and to restrain items in optional outside pockets when the folded-case mode is not in a vertical position.

Figure 11:
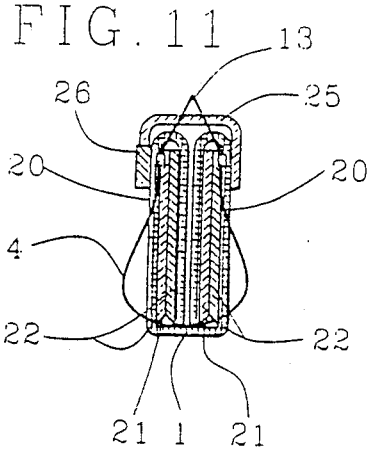
FIG. 11 is a side view of the straddle pack organizer in a folded and locked embodiment with accordion-type pocket sections and divided-section pockets.

Referring to FIG. 11, the lock sheet 25 is positioned over fold lines 11 and 12 and through loops of handle straps 13 to the lock receiving member at the opposite side of the folded mode. A means of attaching, fastening or locking lock sheet 25 to lock receiving member 26 can be any appropriate conventional fastening means employed for the applicable use-conditions. Included for light and flimsy material used in construction could be Velcro ®, a snap, a hook or even a button and button hole. Included for thick, stiff and heavy-duty material such as leather, canvas, and some plastics could be fasteners similar to those used for brief cases and hand bags.

Figure 12:
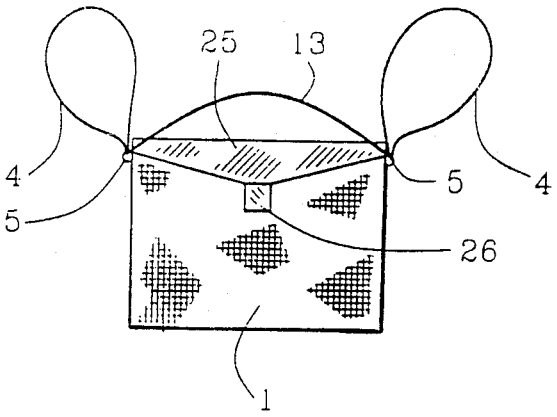
FIG. 12 is an end view of the FIG. 11 illustration and with pack-carrying straps in an arm-insertable condition.

In FIG. 12, the lock sheet 25 is shown extended over the top and attached to the lock-receiving member 26 in the same mode as for the different form of the straddle pack organizer shown in FIG. 7.

Figure 13:
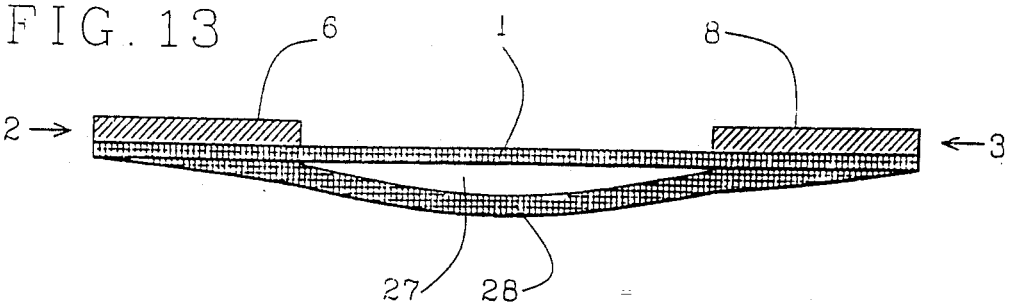
FIG. 13 is a side view of an open straddle pack organizer having a linear pocket for carrying foldable items such as clothing in the central straddle-sheet and pocket sections.

Referring to FIG. 13, a linear pocket 27 can be provided between central straddle-sheet section 1 and an optional second central-section wall 28. This linear pocket can be extended the length of only the central straddle-sheet section 1 or the either the entire length of the straddle pack organizer. Its construction can be achieved by forming the central straddle-sheet section 1 of two layers which are sewn or otherwise attached to the pocket sections 2 and 3 while being left unsewn or open between the pocket sections 2 and 3. Linear pocket 27 is useful primarily for clothing or temporary-shelter items. However, it can also be used for various long and foldable items.

Figure 14:
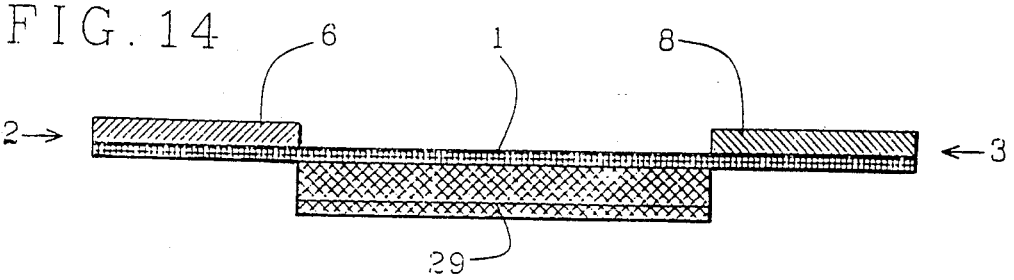
FIG. 14 is a side view of a flat open straddle pack organizer with a fringe on the central straddle-sheet section for attaching it to a platform such as a chair seat or school desk.

Referring finally to FIG. 14, the central straddle-sheet section 1 can be provided with a variety of means for attachment to or arresting movement on a platform such as a chair seat. An optional means for accomplishing this objective is an elasticized skirt or fringe 29 which is attached to the bottom side 16 of the central straddle-sheet section 1 and positionable over a platform. This is a relatively specialized option which will not be so widely used but which can be provided if desired.

This straddle pack organizer can even be referred to as four-folded if each item folded is counted as a fold. It is triple-folded in relation to each fold line. It is double folded in relation to the types of folds employed. In any event, it is a different and more useful item for its intended uses and functions that has been devised previously.

Although numerous embodiments of the invention have been disclosed, further modifications are possible. For instance, puff-paints may be used for decorating or personalizing the organizer and help to secure the organizer over the seat of the chair. Further, the underside of the organizer which touches the seat could be rubberized for non-slip secure positioning and also for water-proofing when the organizer is in the carrying mode. Even further, extra pockets with flaps could be added to the invention so that when the organizer is in the carrying position, additional items could be placed in easy-to-reach position. Additionally, the straddle-pack in the folded position could be used as a seat cushion for a child who is watching television or participating in other activities, especially when no chairs are available.

All modifications, applications, adaptations and forms of this straddle pack organizer foreseeable within the scope or equivalent of the following claims in relation to the foregoing description and drawings are included in this invention.

Having thus described my invention, I claim:

1. A straddle pack organizer for storing objects an being adapted for use with a chair having a horizontal surface, said organizer being convertible to a back pack or a shoulder attached carrier, said straddle pack organizer comprising:

a generally rectangular central straddle sheet section having first and second opposite ends, an upper surface, a lower surface, a length and an outer perimeter, said straddle sheet section having a central fold line parallel to said first and second ends and being located at approximately a midpoint of said length between said first and second ends such that said straddle sheet section is divided into two halves;

a first pocket section having a first interior compartment formed therein and being adapted to receive objects, said first pocket section having a first inner surface and a first outer surface, said first pocket section being connected to said straddle section such that said first end forms a first fold line between said first pocket section and said straddle section, said first pocket section having an opening disposed in said first outer surface adjacent said first fold line for providing access to said first interior compartment;

a second pocket section having a second interior compartment formed therein and being adapted to receive objects, said second pocket section having a second inner surface and a second outer surface, said second pocket section being connected to said straddle section such that said second end forms a second fold line between said second pocket section and said straddle section, said second pocket section having an opening disposed in said second outer surface adjacent said second fold line for providing access to said second interior compartment; and a strap assembly for carrying said straddle pack organizer, said strap assembly including a continuous loop of strap extending around the periphery of said straddle section, a first attachment means adjacent said first fold lien for slidably securing said loop to said straddle pack organizer near said first end, and a second attachment means adjacent said second fold line for slidably securing said loop to said straddle pack organizer near said second end, said straddle pack organizer being configured such that when placed on said chair the lower surface of said straddle section rests upon said horizontal surface and said first and second pocket sections depend downwardly from said straddle section such that a user can gain access to said first and second compartments, said straddle pack organizer being foldable for transporting whereby said first pocket section and said straddle section are folded along said first fold line such that said first outer surface rests upon said upper surface of said straddle section, said second pocket section and said straddle section are folded along said second fold line such that said second outer surface rests upon said upper surface of said straddle section, and said straddle section is folded along said central fold line such that said first inner surface of said first pocket section is adjacent said second inner surface of said second pocket section, wherein said continuous loop of strap is movable with respect to said straddle section such that said continuous loop of strap extends from said first and second attachment means to form spaced loops whereby the organizer can be carried as a back pack assembly with the spaced loops extending over both shoulders of a user such that said straddle sheet section rests upon a user's back or the said continuous loop of strap extends from said first and second attachment means to form adjacent loops whereby the organizer can be carried with the adjacent loops extending over a shoulder of a user such that said straddle sheet section rests upon a user's side.

2. The straddle pack organizer according to claim 1, wherein said straddle sheet section includes a cushion member.

3. The straddle pack organizer according to claim 1, wherein said straddle sheet section includes a pocket located between said upper surface and said lower surface.

4. The straddle pack organizer according to claim 1, wherein said first inner surface includes a pocket formed thereon.

5. The straddle pack organizer according to claim 1, wherein said first inner surface and said second inner surface each include a pocket formed thereon.

* * * * *